US007712199B1

(12) United States Patent
Wilson

(10) Patent No.: US 7,712,199 B1
(45) Date of Patent: May 11, 2010

(54) PORTABLE APPARATUS FOR INSTALLING FLOOR BOARDS AND ASSOCIATED METHOD

(76) Inventor: George Wilson, 519 Jasper Colson Rd., Hazlehurst, GA (US) 31539

( * ) Notice: Subject to any disclaimer, the term of this patent is extended or adjusted under 35 U.S.C. 154(b) by 0 days.

(21) Appl. No.: 11/998,192

(22) Filed: Nov. 29, 2007

(51) Int. Cl.
*B23P 19/04* (2006.01)

(52) U.S. Cl. ..... 29/254; 29/270; 29/278; 254/25

(58) Field of Classification Search ..... 29/254, 29/255, 275, 270, 271, 278, 280; 254/25, 254/21
See application file for complete search history.

(56) References Cited

U.S. PATENT DOCUMENTS

D272,712 S * 2/1984 Allen ..... D8/89
5,109,739 A * 5/1992 Hull et al. ..... 81/463
5,875,534 A * 3/1999 Jackson ..... 29/255
6,158,100 A * 12/2000 Peterson et al. ..... 29/267
6,308,934 B1 * 10/2001 Gallo ..... 254/25
6,880,217 B2 * 4/2005 Garst ..... 29/235
7,168,144 B1 * 1/2007 Haelle ..... 29/254

* cited by examiner

*Primary Examiner*—Lee D Wilson

(57) ABSTRACT

A manually operable hand tool for installing laminate flooring includes an elongated shaft and a base member statically connected to the elongated shaft and including a downwardly averted shoulder spaced from a distal end of the shaft. A first handle is slidably engaged with the shaft, and a stop member is statically affixed to the distal end of the shaft. A second handle is connected to the base member and extends upwardly from a top surface thereof. Such a second handle is forwardly offset at an oblique angle biased towards the averted shoulder and is securely welded to the base member for providing an additional gripping surface seated above the base member for applying additional weight to the base member during installation procedures.

1 Claim, 2 Drawing Sheets

PORTABLE APPARATUS FOR INSTALLING FLOOR BOARDS AND ASSOCIATED METHOD

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Technical Field

This invention relates to hand tools and, more particularly, to a portable apparatus for installing laminate flooring on a floor surface.

2. Prior Art

Laminate flooring is the hottest trend to hit the residential flooring industry since the early days of linoleum! As the younger generation of homeowners look to modernize the look and feel of their decor, laminate flooring has slowly become one of the hottest consumer products on the house and home market. Laminate flooring is an ultra-durable product that looks like a real wood or stone floor. But it's less costly than the 'real thing', easier to install and can last a lot longer. Laminate floors are quickly becoming the flooring of choice for active families and homeowners. If you love the gorgeous look of a wood or stone floor but are worried about high traffic that can ruin expensive floors, laminate flooring is probably the best option on the market. Laminate flooring is a lot like Formica countertops—a combination of layers of wood and melamine plastic that imitate real wood, stone or other textures. But what you're seeing when you look at laminate flooring is actually a picture—a high-quality photograph of real wood or stone that has been placed on top of the floor and covered with ultra-strong, clear plastic. Laminate flooring is available in planks, strips and tiles.

Traditionally, it is glued into place, but in the past few years manufacturers have introduced some incredible glueless and pre-glued formats that cut installation time in half! Laminate flooring is installed on top of your existing floor. And, if you choose a glueless floor, you can even remove the floor and take it with you when you move! One of the few disadvantages to laminate flooring is that it cannot be refinished, sanded or stripped. However, with some of the strongest warranties in the flooring industry, there's not much chance you'll ever need to replace your laminate floor! However, the installation of laminate flooring can be both difficult and tedious at times. Obviously it would be advantageously to develop a device that would make the installation of laminate flooring simple and convenient.

U.S. Pat. No. 5,971,361 to Heimbach discloses a clampless flooring tool that includes a base, a wedge sidewardly guidable by and in slidable contact with the base, and a force applying device secured to the base and in contact with the wedge, which drives the wedge sidewardly. The wedge provides a force oblique to the force applied from the force applying device such that a flooring piece can be acted upon by the oblique force in a direction oblique to the direction of the force applied by the force applying device. An obliquely movable member, which, in addition, may be sidewardly immovable, may be provided between and in contact with the wedge for contact with the flooring. The tool is especially useful in installation of laminate flooring. Unfortunately, this prior art example may still require use of a hammer.

U.S. Pat. No. 5,788,221 to Muhlebach discloses a multipart gripping device for pressing together flooring elements, such as laminates and finished parquet, in side-by-side relationship includes two rod parts that are axially and telescopically connected. One of said rod parts includes a pressure jaw at an end having parallel shoulders that extend toward the other rod part, the shoulders being at a different spacing from the associated rod part for abutting a base portion of a flooring element over which the gripping device is positioned. A longitudinally adjustable lead screw is pivotally connected between the two rod parts for moving the two rod parts together, such that a connecting pressure is applied to a flooring element being interconnectably positioned adjacent one or more previously positioned flooring elements. Unfortunately, this prior art example is not designed to work with the pushing and pulling motions of a user's weight.

U.S. Pat. No. 5,964,450 to Pasto discloses a flooring tool for the installation or repair of wooden tongue and groove flooring. The tool has a jack for exerting linear force, with a fixed and a movable portion. A pivoting gripper is mounted upon the movable portion, and a guide is mounted upon the fixed portion, which allows a brace such as a 2 by 4 board to be inserted into the guide and gripper and held in place, extending the reach and usefulness of the tool. A foot upon a push-pull rod extends downwards from the fixed portion of the jack, and pushes upon the flooring planks. In a preferred embodiment, two attachment points are provided for the foot on its rod, at each end of the fixed portion, providing maximum flexibility. Unfortunately, this prior art example is not designed to work with various types of floor boards.

Accordingly, the present invention is disclosed in order to overcome the above noted shortcomings. The present invention is convenient and easy to use, lightweight yet durable in design, and designed for installing laminate flooring on a floor surface. The manually operable hand tool is simple to use, inexpensive, and designed for many years of repeated use.

BRIEF SUMMARY OF THE INVENTION

In view of the foregoing background, it is therefore an object of the present invention to provide an apparatus for installing laminate flooring on a floor surface. These and other objects, features, and advantages of the invention are provided by a manually operable hand tool.

A manually operable hand tool for installing laminate flooring includes an elongated shaft and a base member statically connected to the elongated shaft and including a downwardly averted shoulder spaced from a distal end of the shaft. Such a downwardly averted shoulder is monolithically formed with the base member and is registered orthogonal thereto. The base member includes a planar central section effectively provided with an angled proximal end offset from the central section at an oblique angle. Such an angled proximal end is directly mated to a distal end of the shaft such that the shaft and the first handle are upwardly offset from the central section. The shaft is statically welded to the proximal end of the base member and further lies flush with the proximal end of the base member.

The apparatus further includes a first handle slidably conveniently engaged with the shaft. Such a first handle is asymmetrically formed, with a distal end being proportionately larger than a proximal end for increasing a user grip on the first handle during operating procedures. A stop member is affixed to a proximal end of the shaft for preventing removal of the first handle from the shaft. Such a stop member is statically affixed to the distal end of the shaft. The handle includes an axial bore centrally aligned and extending through an entire longitudinal length of the first handle, and the shaft is interfitted through the bore.

The apparatus further includes a second handle connected to the base member and advantageously extending upwardly from a top surface thereof. Such a second handle is forwardly offset at an oblique angle biased towards the averted shoulder and is securely welded to the base member for providing an additional gripping surface seated above the base member for applying additional weight to the base member during installation procedures.

A method for installing laminate flooring on a floor surface includes the steps of: providing an elongated shaft; statically connecting a base member to the shaft; slidably engaging a first handle with the shaft; and affixing a stop member to a proximal end of the shaft for preventing removal of the first handle from the shaft; securely welding a second handle to the base member for providing an additional gripping surface seated above the base member; positioning a downwardly averted proximal edge of the base member against the laminate board; simultaneously applying additional weight to the second handle while forwardly sliding the first handle along the shaft and towards the averted shoulder; and adjustably positioning a washer between the first handle and the stopper for absorbing an impact force from the first handle and thereby shielding the stopper during operating conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 4 is a perspective view of the handle, in accordance with the present invention.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
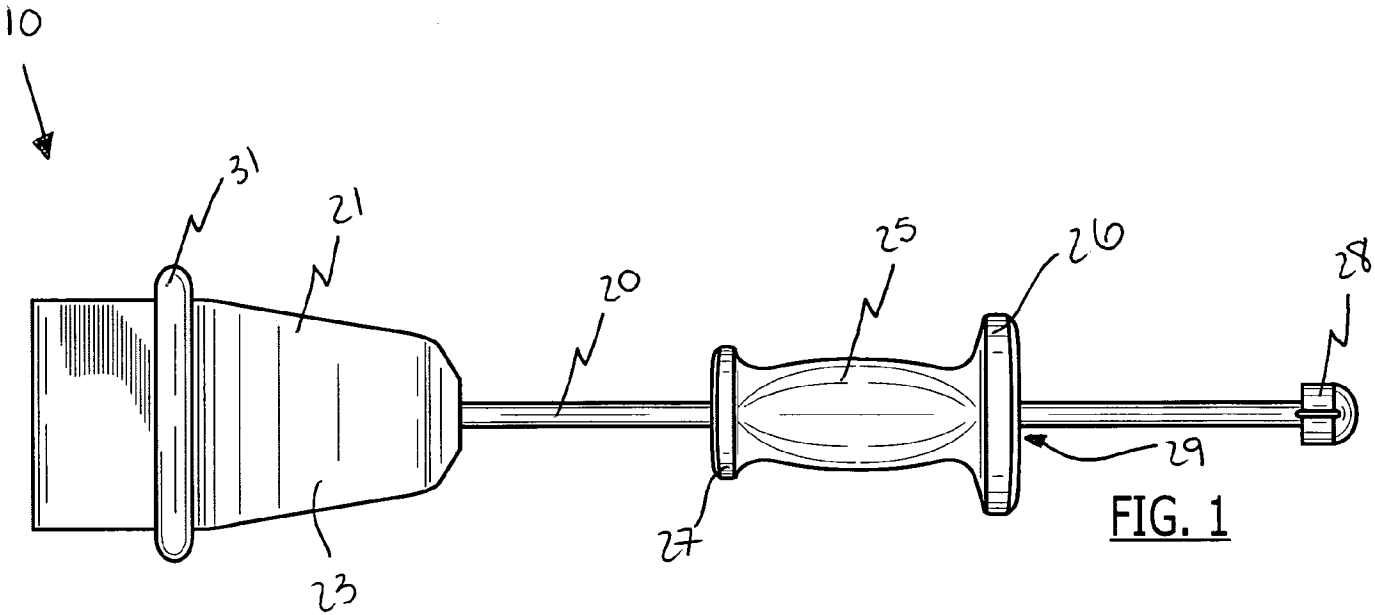
FIG. 1 is a top planar view of a manually operable hand tool, in accordance with the present invention.
Figure 2:
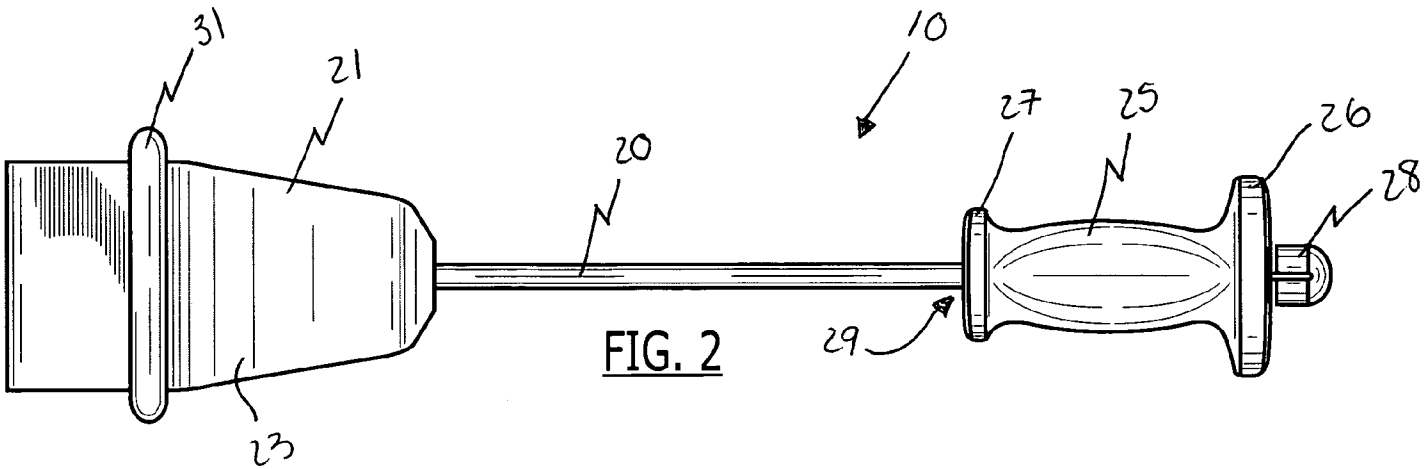
FIG. 2 is a top planar view of a manually operable hand tool, in accordance with the present invention.
Figures 3, 4A, 4B:
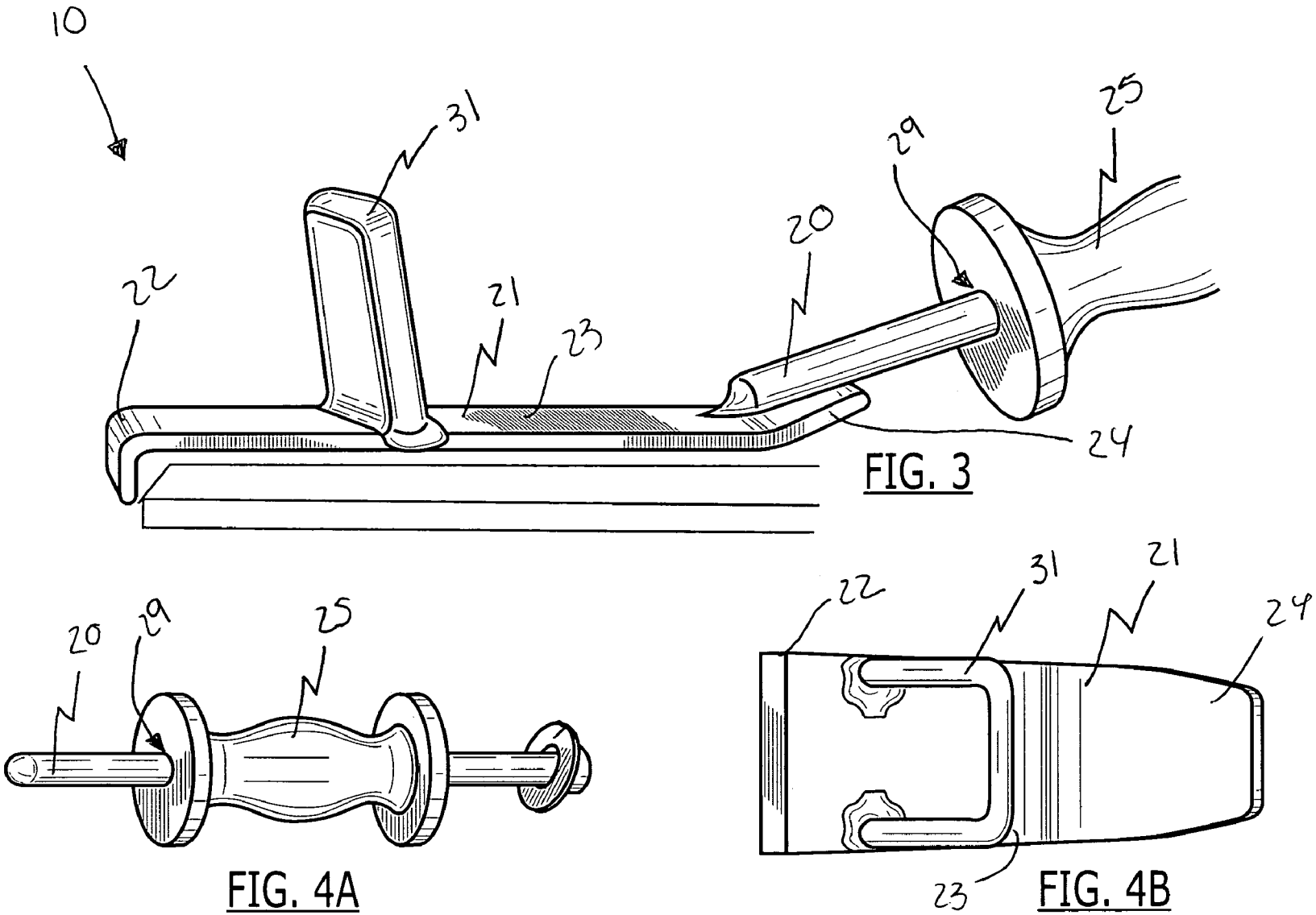
FIG. 3 is a perspective view of a manually operable hand tool, in use with a piece of laminate flooring, in accordance with the present invention.
FIG. 4B is a top planar view of the second handle, in accordance with the present invention.

The apparatus of this invention is referred to generally in FIGS. 1-4B by the reference numeral 10 and is intended to protect a manually operable hand tool. It should be understood that the apparatus 10 may be used to protect many different types of hand tools and should not be limited in use with only those types of hand tools mentioned herein.

Referring initially to FIGS. 1, 2, 3 and 4B, a manually operable hand tool 10 for installing laminate flooring includes an elongated shaft 20 and a base member 21 statically connected to the elongated shaft 20 and including a downwardly averted shoulder 22 spaced from a distal end of the shaft 20. Such a downwardly averted shoulder 22 is monolithically formed with the base member 21 and is registered orthogonal thereto. The base member 21 includes a planar central section 23 provided with an angled proximal end 24 offset from the central section 23 at an oblique angle. Such an angled proximal end 24 is directly mated, without the use of intervening elements, to a distal end of the shaft 20 which is essential such that the shaft 20 and a first handle 25 are upwardly offset from the central section 23. The shaft 20 is statically welded to the proximal end of the base member 21 and further lies flush with the proximal end of the base member 21. The base member 21 and averted shoulder 22 are used for gripping a laminate floor board.

Referring to FIGS. 1, 2, 3 and 4A, the apparatus 10 further includes the first handle 25 slidably engaged with the shaft 20. Such a first handle 25 is asymmetrically formed, with a distal end 26 being proportionately larger than a proximal end 27 for increasing a user grip on the first handle 25 during operating procedures. A stop member 28 is affixed to a proximal end of the shaft 20 for preventing removal of the first handle 25 from the shaft 20. Such a stop member 28 is statically affixed to the distal end of the shaft 20, and preferably includes a plug welded to the end of the shaft 20. The handle 25 includes an axial bore 29 centrally aligned and extending through an entire longitudinal length of the first handle 25, and the shaft 20 is interfitted through the bore 29. The stop member 28 is provided for preventing inadvertent removal of the first handle 25 from the shaft 20.

Referring to FIGS. 1, 2, 3 and 4B, the apparatus 10 further includes a second handle 31 connected to the base member 21 and extending upwardly from a top surface thereof. Such a second handle 31 is forwardly offset at an oblique angle biased towards the averted shoulder 22 and is securely welded to the base member 21 for providing an additional gripping surface seated above the base member 21 for applying additional weight to the base member 21 during installation procedures. The second handle 31 is provided for better gripping the base member 21.

The present invention, as claimed, provides the unexpected and unpredictable benefit of an apparatus for installing laminate flooring that does not require the use of a hammer. Anyone who has installed laminate flooring will appreciate this product. It works by pulling and pushing the weight of a user, making the job easier. The product measures approximately three inches in width by 18 inches in length. It is shaped like a flat triangle and contains a rod with a weight on it, and a handle. It is further constructed of a durable material.

In use, a method for installing laminate flooring on a floor surface includes the steps of: providing an elongated shaft 20; statically connecting a base member 21 to the shaft 20; slidably engaging a first handle 25 with the shaft 20; and affixing a stop member 28 to a proximal end of the shaft 20 for preventing removal of the first handle 25 from the shaft 20; securely welding a second handle 31 to the base member 21 for providing an additional gripping surface seated above the base member 21; positioning a downwardly averted proximal edge of the base member 21 against the laminate board; and simultaneously applying additional weight to the second handle 31 while forwardly sliding the first handle 25 along the shaft 20 and towards the averted shoulder 22.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A manually operable hand tool for installing laminate flooring on a floor surface, said manually operated hand tool comprising:

an elongated shaft;

a base member statically connected to said base member and including a downwardly averted shoulder spaced from a distal end of said shaft, said downwardly averted shoulder being monolithically formed with said base member and being registered orthogonal thereto;

a first handle slidably engaged with said shaft; and a stop member affixed to a proximal end of said shaft for preventing removal of said first handle from said shaft;

wherein said base member comprises a planar central section providing with an angled proximal end offset from said central section at an oblique angle, said angled proximal end being directly mated to a distal end of said shaft such that said shaft and said first handle are upwardly offset from said central section, wherein said shaft is statically welded to said proximal end of said base member and further lies flush with said proximal end of said base member.

* * * * *